US009293834B2

(12) United States Patent
Latrach et al.

(10) Patent No.: US 9,293,834 B2
(45) Date of Patent: Mar. 22, 2016

(54) ANTENNA STRUCTURES COMBINING METAMATERIALS

(75) Inventors: Mohamed Latrach, Angers (FR); Wafa Abdouni-Abdallah, Cholet (FR)

(73) Assignee: ECOLE SUPERIEURE ELECTRONIQUE DE L'OUEST, Angers Cedex (FR)

( * ) Notice: Subject to any disclaimer, the term of this patent is extended or adjusted under 35 U.S.C. 154(b) by 254 days.

(21) Appl. No.: 14/008,904

(22) PCT Filed: Mar. 19, 2012

(86) PCT No.: PCT/EP2012/054841
§ 371 (c)(1),
(2), (4) Date: Jan. 6, 2014

(87) PCT Pub. No.: WO2012/130661
PCT Pub. Date: Oct. 4, 2012

(65) Prior Publication Data

US 2014/0111400 A1 Apr. 24, 2014

(30) Foreign Application Priority Data

Mar. 31, 2011 (FR) ..... 11 52692

(51) Int. Cl.
*H01Q 1/38* (2006.01)
*H01Q 15/00* (2006.01)

(52) U.S. Cl.
CPC ..... *H01Q 15/0086* (2013.01); *H01Q 15/0026* (2013.01)

(58) Field of Classification Search
CPC ..... H01Q 15/0086; H01Q 15/0026
USPC ..... 343/700 MS, 702
See application file for complete search history.

(56) References Cited

U.S. PATENT DOCUMENTS

2005/0035909 A1* 2/2005 Lin ..... 343/700 MS
2010/0301971 A1 12/2010 Yonak et al.

FOREIGN PATENT DOCUMENTS

WO 2008/121159 A2 10/2008
WO 2010/036290 A2 4/2010
WO 2010/144170 A2 12/2010

OTHER PUBLICATIONS

French Search Report and Written Opinion dated Feb. 10, 2012 for corresponding French Patent Application No. 1152692, filed Mar. 31, 2011.

(Continued)

*Primary Examiner* — Hoang V Nguyen
(74) *Attorney, Agent, or Firm* — David D. Brush; Westman, Champlin & Koehler, P.A.

(57) ABSTRACT

A metamaterial structure including at least one basic unit including a mounting made of a dielectric material. The mounting has an upper surface and a lower surface. Each basic unit includes an electrically conductive unit arranged on the upper surface of the mounting and including: a first C-shaped conductive element including first and second ends; a second C-shaped conductive element including third and fourth ends, the first and second conductive elements being arranged relative to one another such that the first and third ends are opposite one another and separated by a first space, and the second and fourth ends are opposite one another and separated by a second space; and a connector configured so as to connect the first end to the fourth end.

9 Claims, 13 Drawing Sheets

(56) References Cited

OTHER PUBLICATIONS

International Search Report dated Jun. 28, 2012 for corresponding International Patent Application No. PCT/EP2012/054841, filed Mar. 19, 2012.

International Preliminary Report on Patentability and Written Opinion dated Oct. 2, 2013 for corresponding International Patent Application No. PCT/EP2012/054841, filed Mar. 19, 2012.

Phillippe Gay-Balmaz and Olivier J. F. Martin: "Electromagnetic resonances in individual and coupled split-ring resonators". Electromagnetic Fields and Microwave Electronics Laboratory Swiss Federal Institute of Technology, Journal of Applied Physics, vol. 92, No. 5, Sep. 1, 2002, pp. 2929-2936.

Jiunn-Nan Hwang and Fu-Chiarng Chen: "Reduction of the Peak SAR in the Human Head With Metamaterials", IEEE Transactions on Antennas and Propagation, vol. 54, No. 12, Dec. 2006 (Dec. 1, 2006), pp. 3763-3770.

S. S. Karthikeyan, Mahendra Babu Manapati, and Rakhesh S. Kshetrimayum: "Reduction of specific absorption rate in human tissues using split ring resonators", Department of Electronics and Communication Engineering Indian Institute of Technology Guwahati Assam, India 781039, 2009, 4 pages.

Lin Wang et al.: "A Dual-Band Printed Electrically Small Antenna Covered by Two Capacitive Split-Ring Resonators", IEEE Antennas and Wireless Propagation Letters, vol. 10, 2011, pp. 824-826.

Thomas H. Hand et al.: "Controllable Magnetic Metamaterial Using Digitally Addressable Split-Ring Resonators", IEEE Antennas and Wireless Propagation Letters, vol. 8, 2009, pp. 262-265.

* cited by examiner

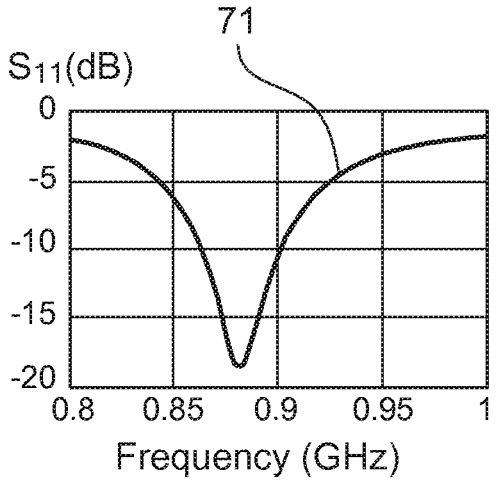
Fig. 7a
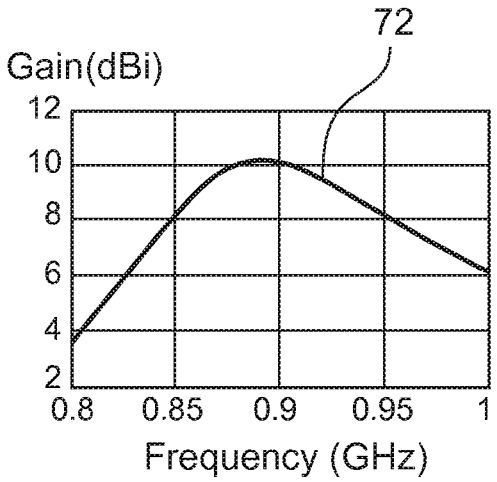
Fig. 7b
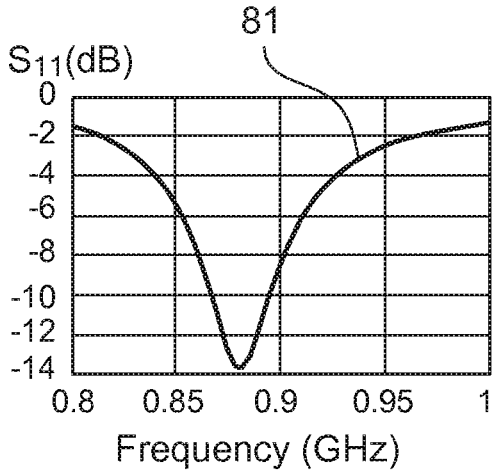
Fig. 8a
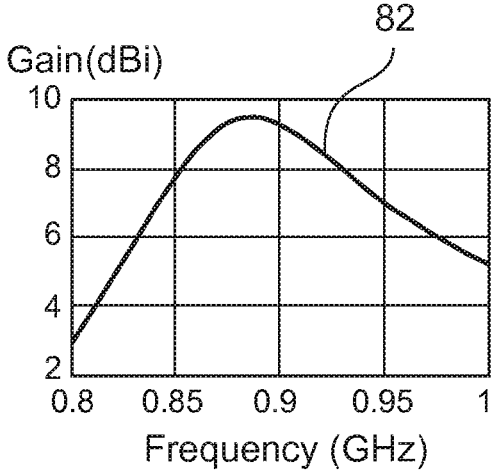
Fig. 8b
Fig. 9
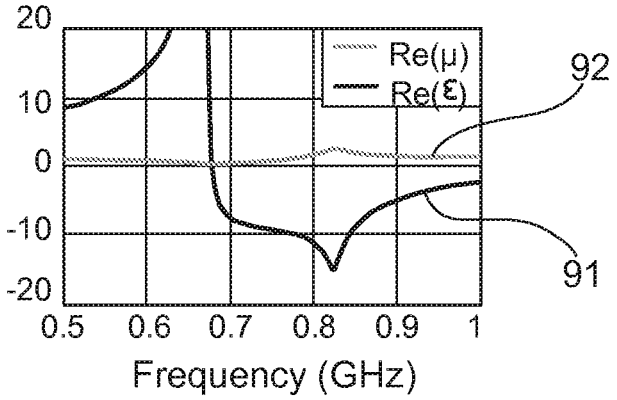

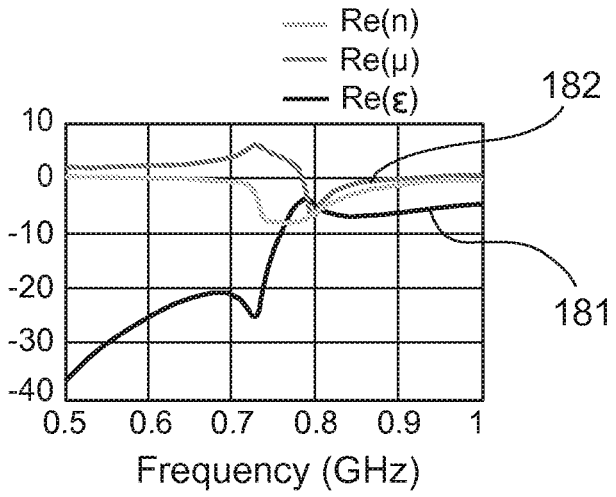
Fig. 17
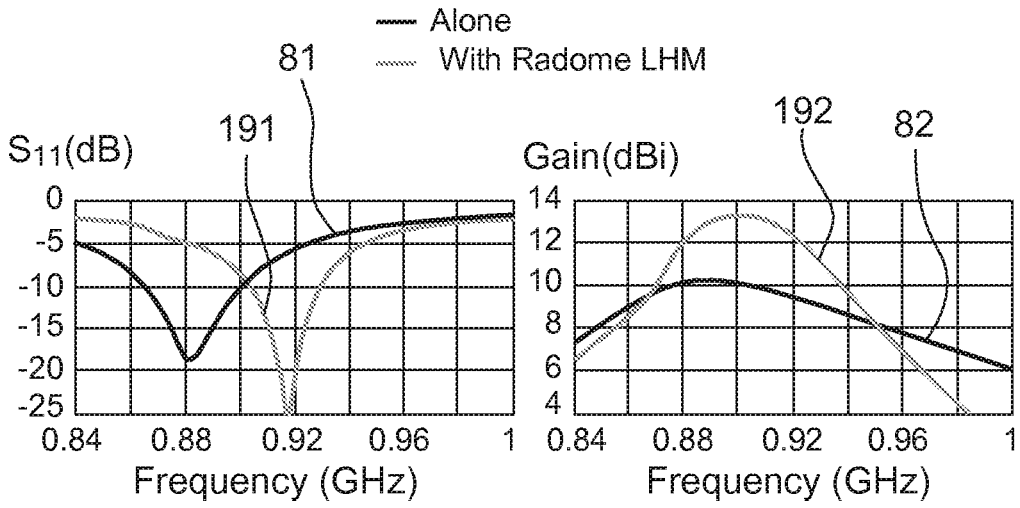
Fig. 18a
Fig. 18b

ANTENNA STRUCTURES COMBINING METAMATERIALS

1. CROSS-REFERENCE TO RELATED APPLICATIONS

This Application is a Section 371 National Stage Application of International Application No. PCT/EP2012/054841, filed Mar. 19, 2012, which is incorporated by reference in its entirety and published as WO 2012/130661 on Oct. 4, 2012, not in English.

2. FIELD OF THE INVENTION

The field of the invention is that of electromagnetic waves, preferably in the ultra-high frequency (UHF) range (300 MHz to 3 GHz) or the microwave frequency (3 GHz to 300 GHz) range.

More specifically, the invention pertains to a structure of metamaterials comprising elementary blocks of metamaterial as well as an antenna system (here below also called an antenna structure) using such a structure of metamaterials as an antenna radome.

The invention can be applied especially but not exclusively to all antenna systems for which it is sought to increase the directivity and the antenna gain and minimize the rear and lateral radiation. For example, the invention can be applied to RFID base stations in the UHF band.

3. TECHNOLOGICAL BACKGROUND

The need to reduce the space requirement of antenna systems and the search for improved radiation performance and lower manufacturing costs are leading the designers of these systems to develop novel materials.

Recent years have seen a major interest in metamaterials. The notion of metamaterials is well known and is discussed for example in J. B. Pendry, A. J. Holden, D. J. Robbins, and W. J. Stewart, "Magnetism from conductors and enhanced nonlinear phenomena," IEEE Trans. Microw. Theory Tech., vol. 47, no. 11, pp. 2075-2084, 1999.

It may simply be recalled that metamaterials are by definition metal-dielectric composite media. They are periodic structures whose constituent elements are metal inclusions of very small dimensions relative to the wavelength ($<\lambda/10$).

There are many types of metamaterial structures.

Electric metamaterials are metamaterials which have electric behavior and are liable to show negative permittivity ($\in$) in a given frequency spectrum. The best-known electrical metamaterials are those formed by an array of metal rods.

Magnetic metamaterials are metamaterials which have magnetic behavior and are liable to show negative permeability ($\mu$) in a given frequency spectrum. The best-known magnetic metamaterials are those formed by an array of square or circular split-ring resonators (SRR).

The left-handed materials (LHM) are metamaterials liable to show permittivity ($\in$) and permeability ($\mu$) that are simultaneously negative in a given frequency spectrum. The best-known left-handed materials are those formed by the combination of an array of metal rods and an array of split-ring resonators. With such left-handed materials, it is possible to obtain wholly unexpected propagation phenomena such as opposite phase and group speeds, inverse Doppler effects, negative refraction indices, etc.

In the field of electromagnetic waves, it has been proposed to use left-handed materials of this kind as antenna radomes.

FIG. 1 illustrates an example of an antenna system comprising a radome made of left-handed material based on split-ring resonators and conductive strips. For reasons of clarity, only half of the antenna system is shown in FIG. 1.

The antenna system 10 comprises:

- an antenna 110 comprising:
  - a carrier structure 11 comprising a ground 12 (or ground plane) and a layer 13 of dielectric material and/or magnetic material placed on ground 12;
  - a radiating element 14 placed on the carrier structure 11, and
- a radome 15.

The radome 15 extends above the antenna 110. The radome 15 is separated from the antenna 110 by a volume 16 constituted for example by air or dielectric and/or magnetic material.

The radome 15 comprises a structure of left-handed material. The structure of left-handed material comprises a plurality of elementary blocks 17 arranged in rows and columns in a matrix. Each elementary block 17 comprises a split-ring resonator and a conductive strip.

FIG. 2 illustrates a possible example of an elementary block of left-handed material based on split-ring resonators and conductive strips.

The elementary block of left-handed material 20 comprises a first support 21 made of a dielectric material comprising an upper face 22 on which there is placed a split-ring resonator 24 and a lower face 23 on which there is placed a first linear metal strip 25. The elementary block 20 comprises a second support 26 made of dielectric material comprising a lower face 27 on which there is placed a second linear metal strip 28. The two supports 21 and 26 are separated by an air layer 29.

The split-ring resonator 24 comprises an inner slotted square 241 and an outer slotted square 242. By way of an example, for an X band operation (8.2 GHz to 12.4 GHz), the width of the slot of each slotted square is about 0.3 mm. The width of the different metal tracks (split-ring resonator and metal strips) is about 0.3 mm. The spacing between the inner slotted square 241 and outer slotted square 242 is about 0.3 mm. The volume of an elementary block 20 is about $3.3\times3.3\times4.5\ mm^3$ and the periodicity of the metamaterial structure is about 3.63 mm in the plane and 4.5 mm in depth.

The radome 15 plays the role of a device for diffracting electromagnetic waves and increases the directivity and the gain of the antenna 101 while at the same time reducing the minor lobe and rear radiation levels. This is described especially in detail in the document Shah Nawaz Burokur, Mohamed Latrach, and Serge Toutain "Theoretical Investigation of a Circular Patch Antenna in the Presence of a Left-Handed Medium", IEEE Trans. Antennas and Wireless Propagation Letters, Vol. 4, page 183-186, 2005.

However, this left-handed material structure based on split-ring resonators and conductive strips has several drawbacks.

One of the drawbacks of this structure of left-handed material based on split-ring resonators and conductive strips is that it works only with linear polarization antennas. In other words, this structure cannot be used in circular polarization.

Besides, it is desirable that the structure of left-handed material (forming the antenna radome) should be simple to make and should have the lowest possible cost.

Several solutions have been proposed in this respect.

One known solution is described in the US patent document 2010/0097281. This solution uses a left-handed material based on S-shaped resonators.

FIG. 3 illustrates an example of an elementary block of left-handed material based on S-shaped resonators (placed on one face of a support made of dielectric material) and inverse S-shaped resonators (placed on the other face of the support). The particular feature of this type of resonator 30 is that it has dual resonance, magnetic and electric, without requiring the implementation of small-sized slots and an additional array of metal rods.

Thus, a structure made of left-handed material based on S-shaped resonators has great simplicity of manufacture. However, it has the drawback of not working when the polarization of the antenna is circular.

4. SUMMARY OF THE INVENTION

One particular embodiment of the invention proposes a metamaterial structure comprising at least one elementary block comprising a support made of dielectric material, said support comprising an upper face and a lower face. Said at least one elementary block is such that it comprises a first electrically conductive unit placed on the upper face of the support and comprising:

- a first C-shaped conductive element comprising first and second ends;
- a second C-shaped conductive element comprising third and fourth ends, said first and second conductive elements being laid out relative to each other in such a way that the first and third ends face each other and are separated by a first space, and the second and fourth ends face each other and are separated by a second space;
- a first connector configured to connect the first end to the fourth end.

Advantageously, said first and second C-shaped conductive elements are identical.

Advantageously, the first connector has a rectilinear shape.

Advantageously, each C-shaped conductive element is an arc of a circle, the centre of which corresponds to the mid-point of the first connector.

Advantageously, said at least one elementary block comprises a second electrically conductive unit placed on the lower face of the support and comprising:

- a third C-shaped conductive element comprising fifth and sixth ends;
- a fourth C-shaped conductive element comprising seventh and eighth ends, said third and fourth conductive elements being laid out relative to each other in such a way that the fifth and seventh ends face each other and are separated by a third space, and the sixth and eighth ends face each other and are separated by a fourth space;
- a second connector configured to connect the fifth end to the eighth end.

Advantageously, the mid-points of the first and second connectors are superimposed.

Advantageously, said first and second conductive units are superimposed with a 90° rotation of the first connector relative to the second connector.

Advantageously, said first and second conductive units are identical.

Advantageously, said first conductive unit comprises at least one active component.

Advantageously, said second conductive unit comprises at least one active component.

In another embodiment, the invention pertains to a metamaterial structure comprising at least one elementary block comprising:

- a support made of dielectric material, said support comprising an upper face and a lower face;
- a split-ring resonator placed on the upper face of the support and comprising an inner slotted square and an outer slotted square surrounding said interior slotted square.

The metamaterial structure is such that it is adapted to working in the frequency band ranging from 860 MHz to 960 MHz.

Advantageously, each of the inner and outer slotted squares is formed by a metal track with a width of about 1 mm and comprises a slot with a width of about 2 mm, the slots of the inner and outer slotted squares being aligned relative to each other. Each side of the inner slotted square IS about 17 mm. Each side of the outer slotted square is about 20 mm. The spacing between the inner and outer slotted squares is about 0.5 mm.

Advantageously, said at least one elementary block comprises a rectilinear metal strip with a length of about 22 mm and a width of about 2 mm, placed on the lower face of the support, the slots of the inner and outer slotted squares being superimposed over said metal strip.

5. LIST OF FIGURES

Other features and advantages of the invention shall appear from the following description, given by way of an indicative and non-restrictive example and from the appended figures, of which:

FIG. 1, described here above with reference to the prior art, illustrates an example of an antenna system comprising a radome made of left-handed material based on split-ring resonators and conductive strips;

FIG. 2, described here above with reference to the prior art, illustrates an example of an elementary block made of left-handed material based on split-ring resonators;

FIG. 3, described here above with reference to the prior art, illustrates an example of an elementary block of left-handed material based on S-shaped resonators;

FIG. 4 illustrates an example of an antenna system comprising a radome made of metamaterial according to a first embodiment of the invention;

FIG. 5 presents an example of antenna according to the invention;

FIG. 6 illustrates an elementary block of metamaterial according to the first embodiment of FIG. 4;

FIG. 7*a* presents the curve of the reflection coefficient of the antenna of FIG. 5 in linear polarization;

FIG. 7*b* presents the gain curve of the antenna of FIG. 5 in linear polarization;

FIG. 8*a* presents the curve of the reflection coefficient of the antenna of FIG. 5 in circular polarization;

FIG. 8*b* presents the gain curve of the antenna of FIG. 5 in circular polarization;

FIG. 9 presents the permittivity and permeability curves of an array constituted by elementary blocks of metamaterial of FIG. 6;

FIG. 10*a* presents the curve of the reflection coefficient of the antenna system of FIG. 4 in linear polarization;

FIG. 10*b* presents the gain curve of the antenna system of FIG. 4 in linear polarization;

FIG. 11*a* presents the curve of the reflection coefficient of the antenna system of FIG. 4 in circular polarization;

FIG. 11*b* presents the gain curve of the antenna system of FIG. 4 in circular polarization;

FIG. 11*c* illustrates the configuration in which a radome according to one embodiment of the invention is oriented along an angle of orientation of +45° relative to the antenna;

Figure 11A:
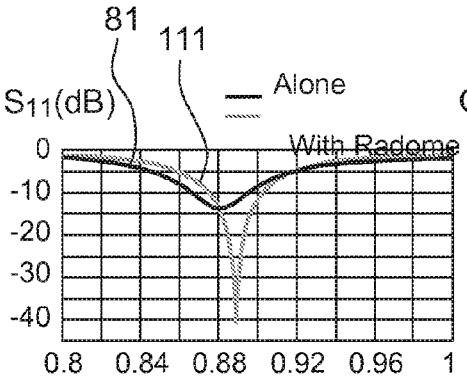
Figure 11B:
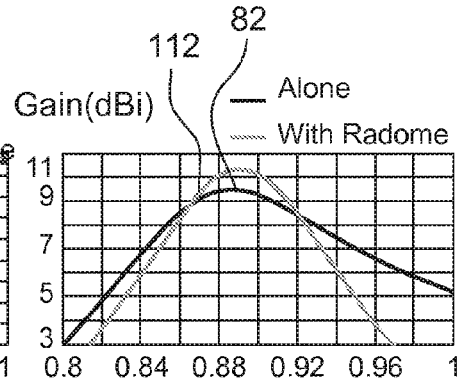
Figure 11C:
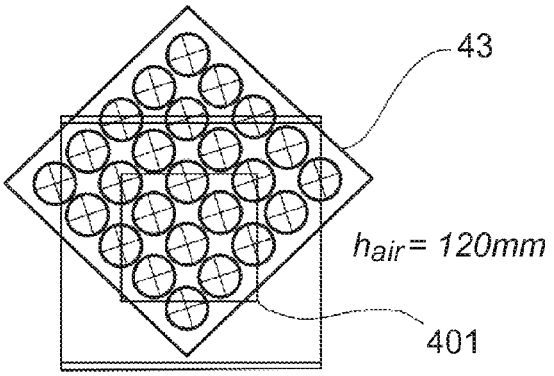
Figure 14A:
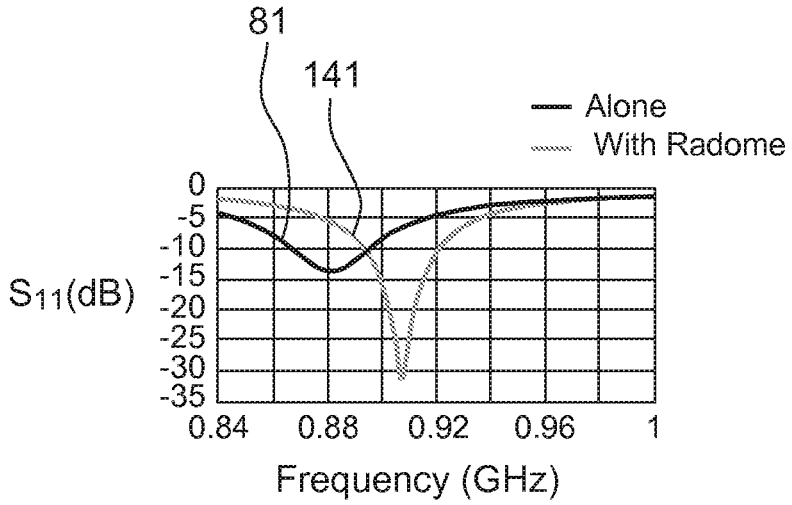
Figure 14B:
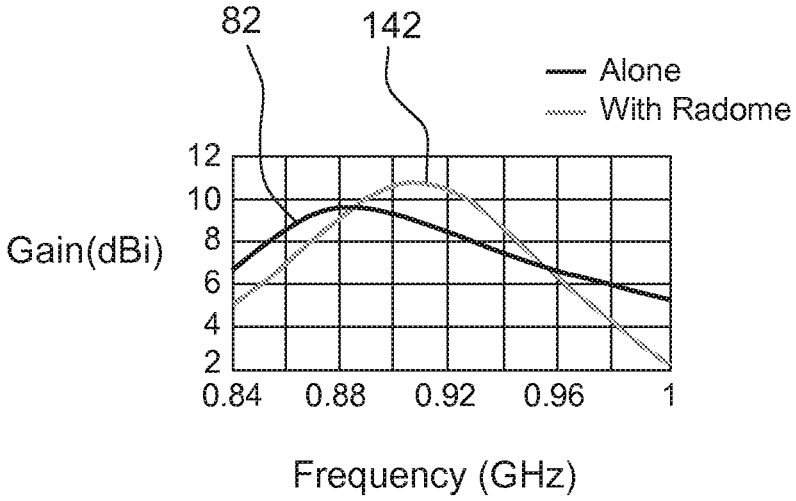
Figure 15:
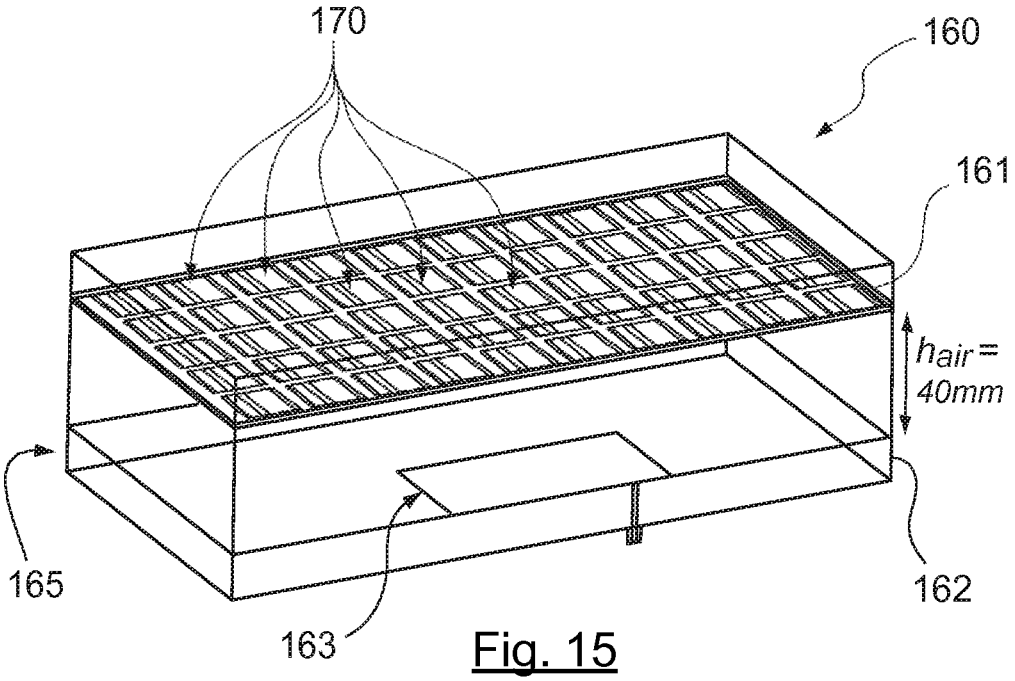
Figure 16:
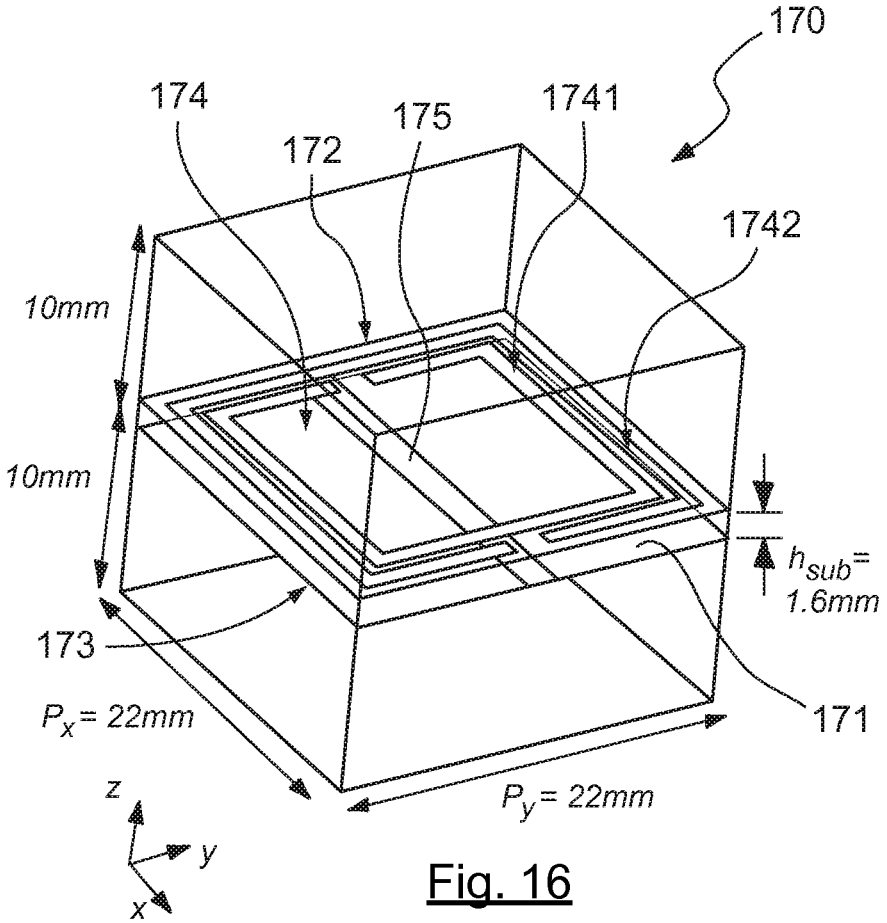
Figure 19:
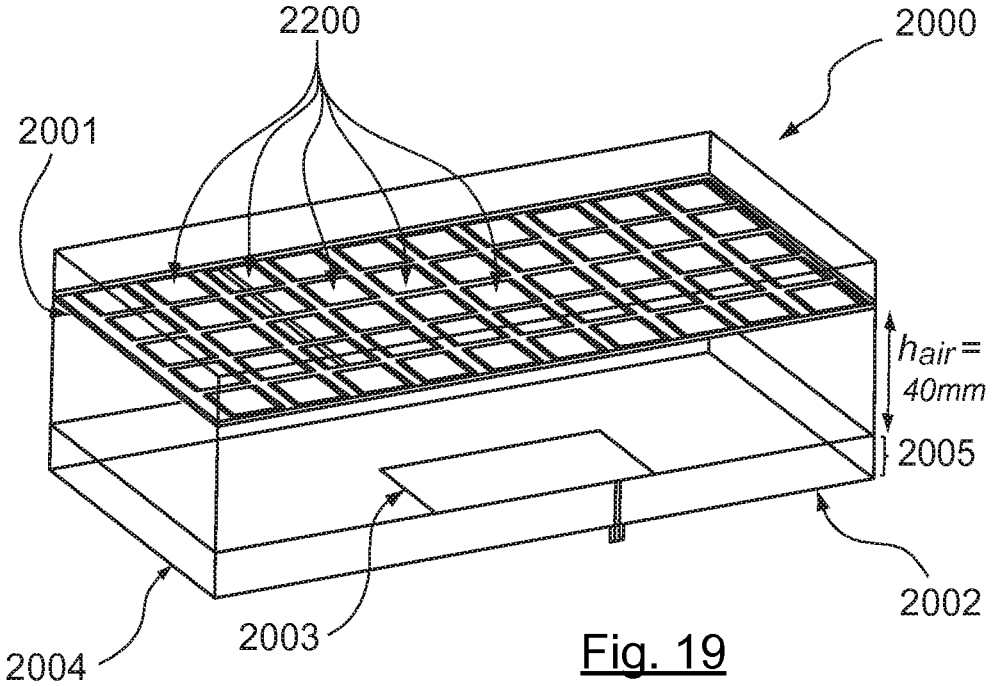
Figure 20:
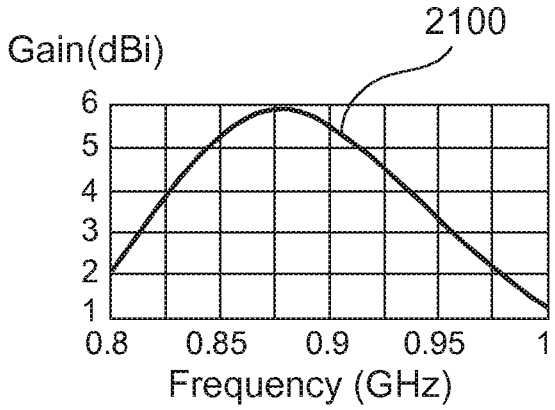
Figure 23:
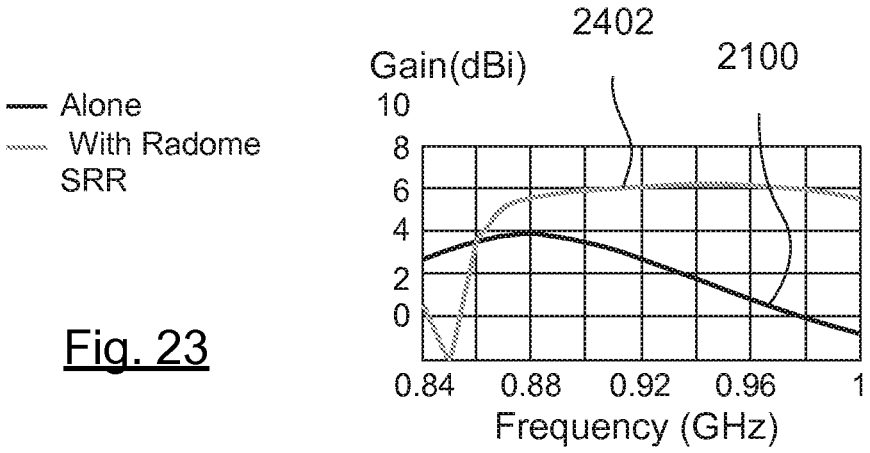
Figure 21:
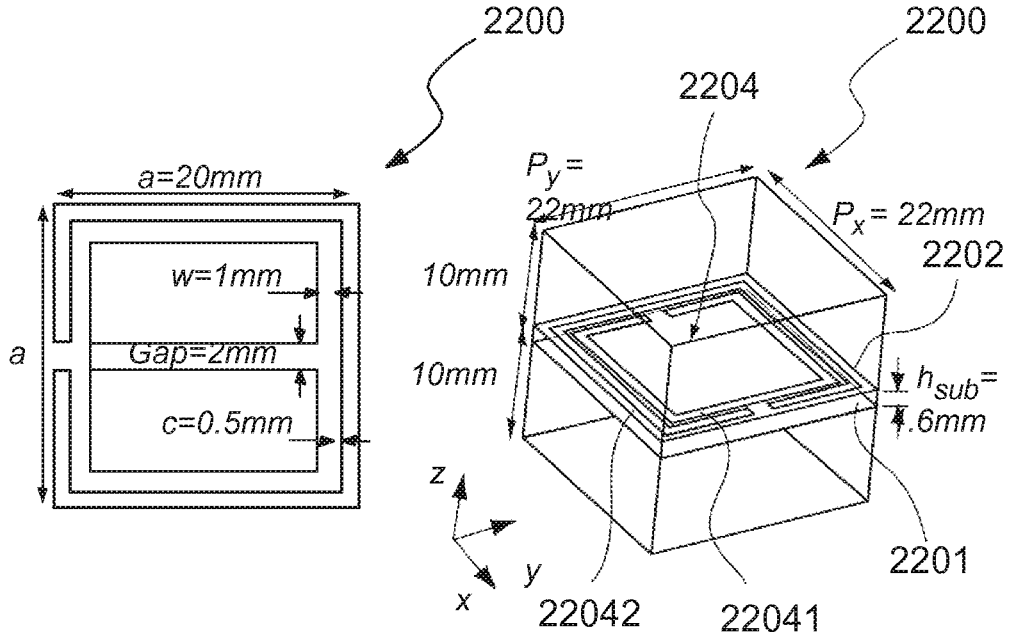
Figure 22:
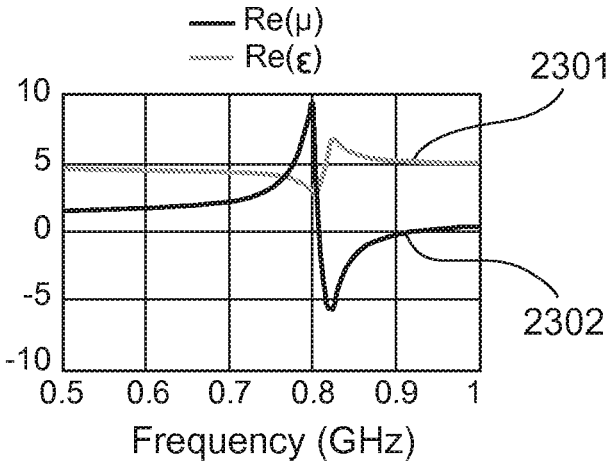
Figure 24:
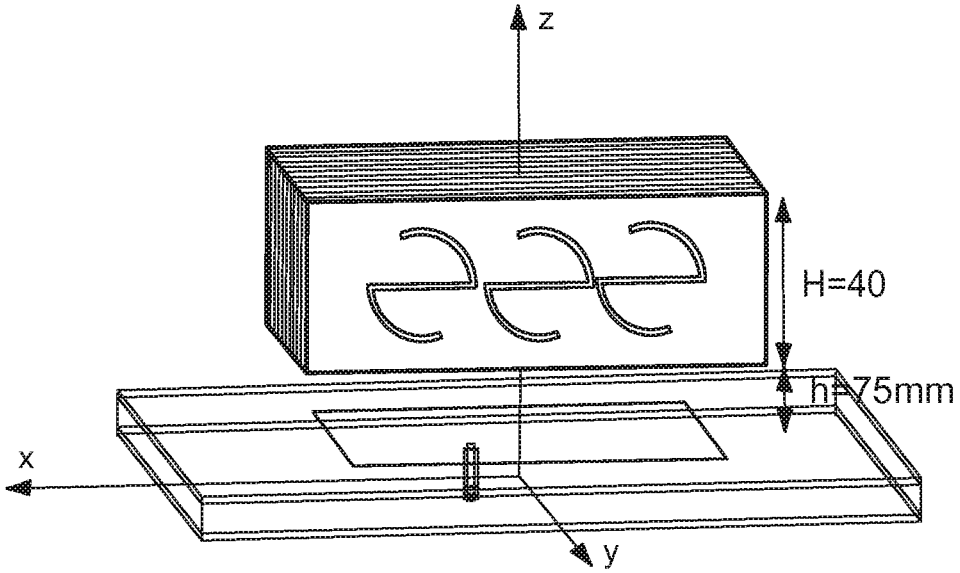
Figure 25:
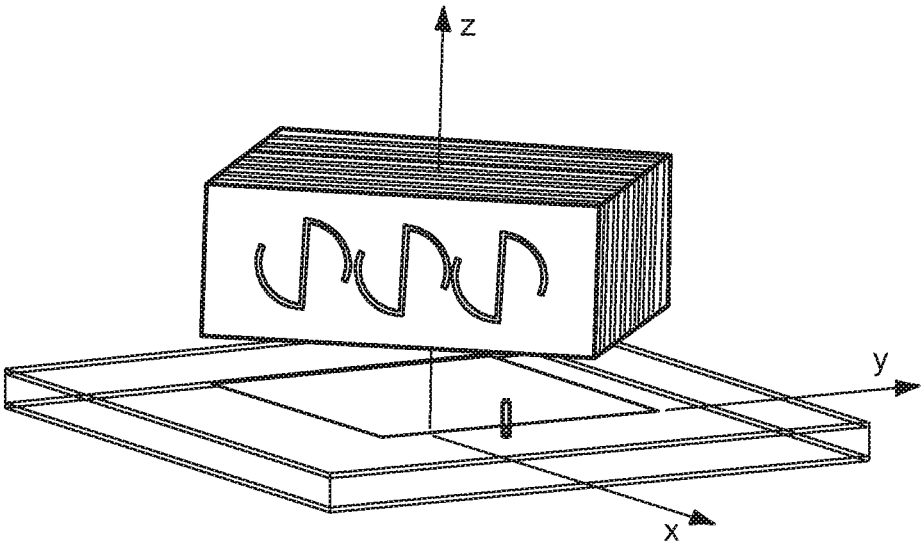
Figure 26:
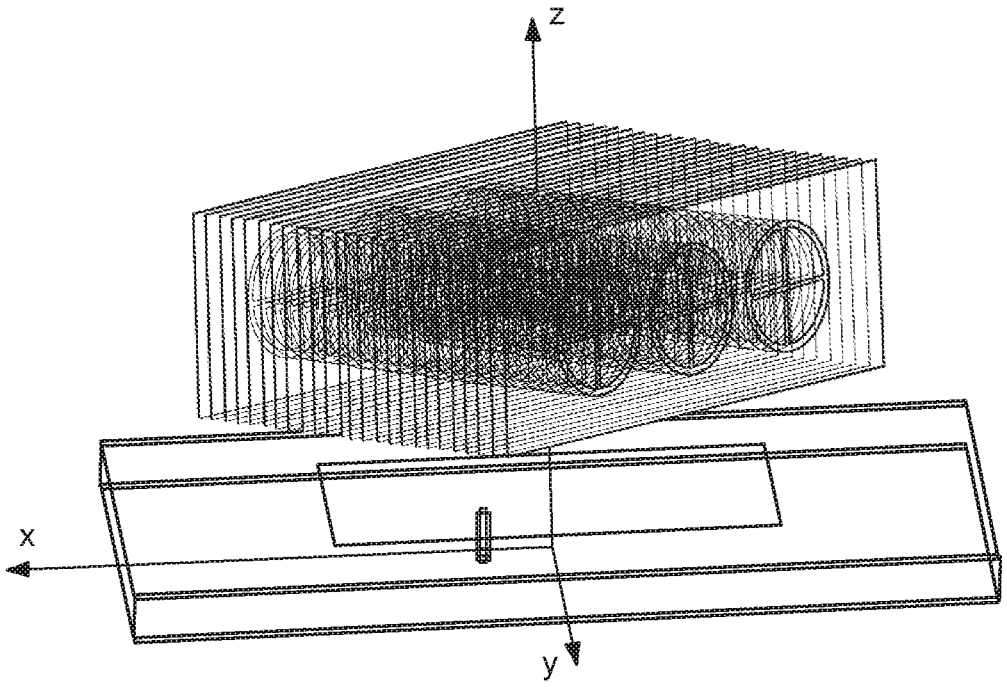

FIG. 14*a* presents the curve of the reflection coefficient of the antenna system of FIG. 11*c* in circular polarization;

FIG. 14*b* presents the gain curve of the antenna system of FIG. 11*c* in circular polarization;

FIG. 15 illustrates an antenna system comprising a radome made of left-handed material optimized for the UHF-RFID band according to one particular embodiment of the invention;

FIG. 16 illustrates an elementary block of left-handed material optimized for the UHF-RFID band according to the embodiment of FIG. 15;

FIG. 17 presents the curves of the real parts of the permittivity, the refractive index and the permeability of an array constituted by two elementary blocks of left-handed material of FIG. 16;

FIG. 18*a* presents the curve of the reflection coefficient of the antenna system of FIG. 15 in linear polarization;

FIG. 18*b* presents the gain curve of the antenna system of FIG. 15 in linear polarization;

FIG. 19 illustrates an antenna system comprising a radome made of metamaterial optimized for the UHF-RFID band according to one particular embodiment of the invention;

FIG. 20 presents the gain curve of the antenna (alone) of FIG. 19 in linear polarization;

FIG. 21 illustrates an elementary block of metamaterial optimized for the UHF-RFID band according to the embodiment of FIG. 19;

FIG. 22 presents the curves of the real parts of permittivity and permeability of an array constituted by elementary blocks of metamaterial of FIG. 21;

FIG. 23 presents the gain curve of the antenna system of FIG. 19 in linear polarization; and FIGS. 24, 25 and 26 each illustrate a configuration in which the radome made of metamaterial according to the invention is positioned vertically to the plane of the radiating element.

6. DESCRIPTION OF ONE EMBODIMENT

The invention therefore proposes structures of metamaterials capable of working in linear polarization and/or circular polarization. The structures of metamaterials according to the invention show negative permittivity and/or negative permeability in a given and relatively wide spectrum of frequencies. They can be used as an antenna radome to increase the directivity and gain of an antenna. The structures of metamaterials according to the invention can be used in the UHF and microwave ranges and for any type of antenna, and it remains simple to manufacture.

The description here below is that of the particular case of an antenna system comprising a patch antenna configured to work in the UHF-RFID band. Those skilled in the art will have no difficulty in extending this teaching to any other type of antenna and any other frequency band.

Figure 4:
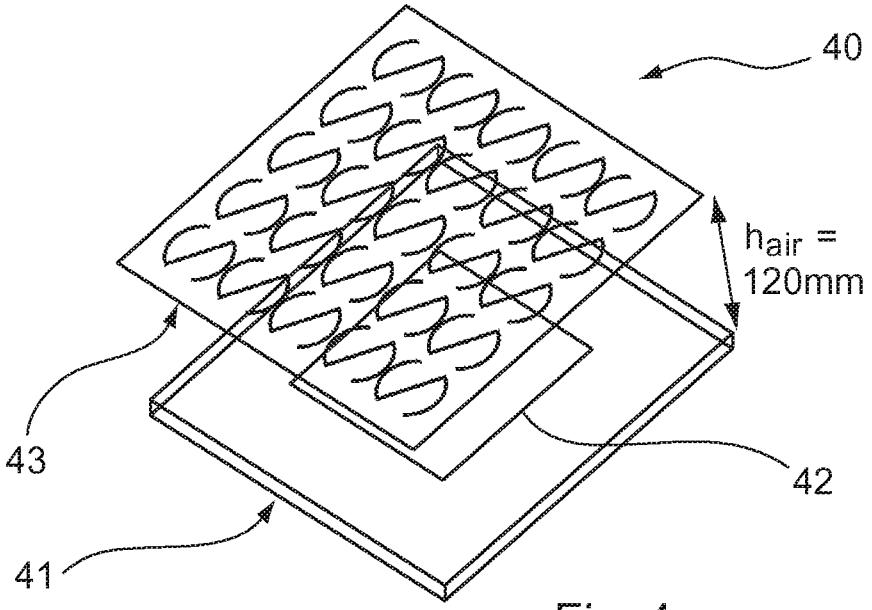

6.1 Radome Made of Metamaterials According to a First Embodiment of the Invention FIG. 4 illustrates an example of an antenna system comprising a radome made of metamaterial according to a first embodiment of the invention.

The antenna system 40 comprises:

- a patch antenna 401 comprising:
  - a carrier structure (for example a dielectric, magnetic or air layer) 41;
  - a square-shaped radiating element 42; and
- a radome 43.

The antenna system 41 is configured and sized to work in the UHF-RFID band. The UHF-RFID band extends from 860 MHz to 960 MHz.

Figure 5:
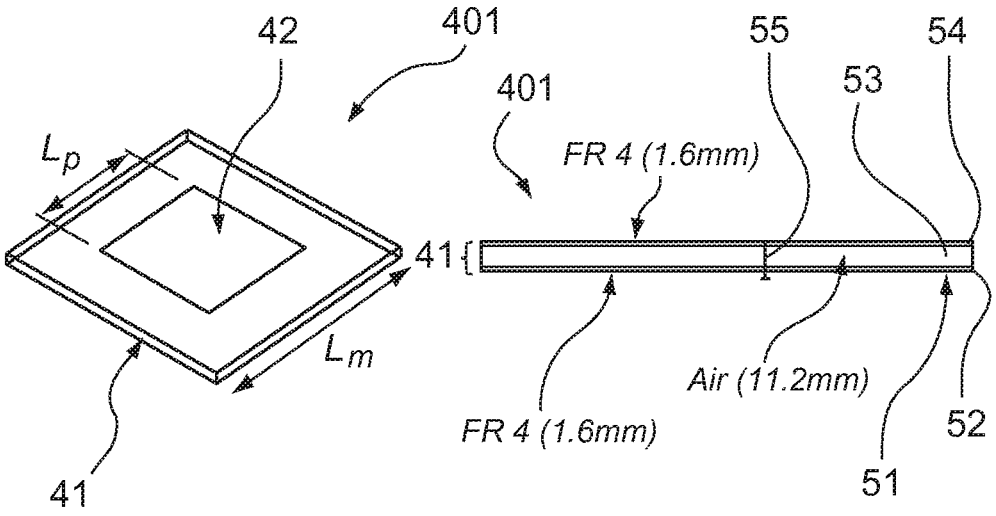

FIG. 5 presents an example of an antenna 401 according to the invention. This FIG. 5 illustrates an example of an embodiment of the carrier structure 41 and the radiating element 42.

In the example of FIG. 5, the carrier structure 41 has a ground plane 51 printed on the lower face of a first layer 52 of dielectric material. The carrier structure 41 comprises a second layer 54 of dielectric material which is separated from the first layer of dielectric material by an air layer 53.

The radiating element 42 is printed on the upper face of the second layer 54 of the dielectric material.

The radiating element 42 and the ground plane 51 are sized to operate in the UHF-RFID band. In one particular embodiment, the radiating element 42 and the ground plane 51 are square-shaped, the length (Lp) of the radiating element 42 being about 130 mm and the length (Lm) of the ground plane 51 being about 250 mm.

The radiating element 42 is fed via a classic connector 55 of the SMA type. A classic SMA connector comprises a central pin with a length of about 15 mm. The excitation of the radiating element 42 can be achieved by different techniques, among the coaxial probe, the microstrip line, a proximity coupling or a slot coupling. In this particular embodiment, the first and second layers of dielectric material 52 and 54 each include an FR4 epoxy layer. In this example of an embodiment, each FR4 epoxy layer has a height of 1.6 mm. This is advantageous in terms of cost price.

In another embodiment, the FR4 epoxy layers can be replaced by air layers (this has the effect especially of reducing production costs and lightening the structure) or other types of substrates.

Since the height of the antenna has to be smaller than 15 mm (height of the SMA connector), the height of the air layer 53 is 11.2 mm.

In this example of an embodiment, the total height of the antenna is therefore 14.4 mm.

The square-shaped radiating element 42 is capable of working both in linear polarization and in circular polarization (depending on the location of the excitation device 55).

Figure 1:
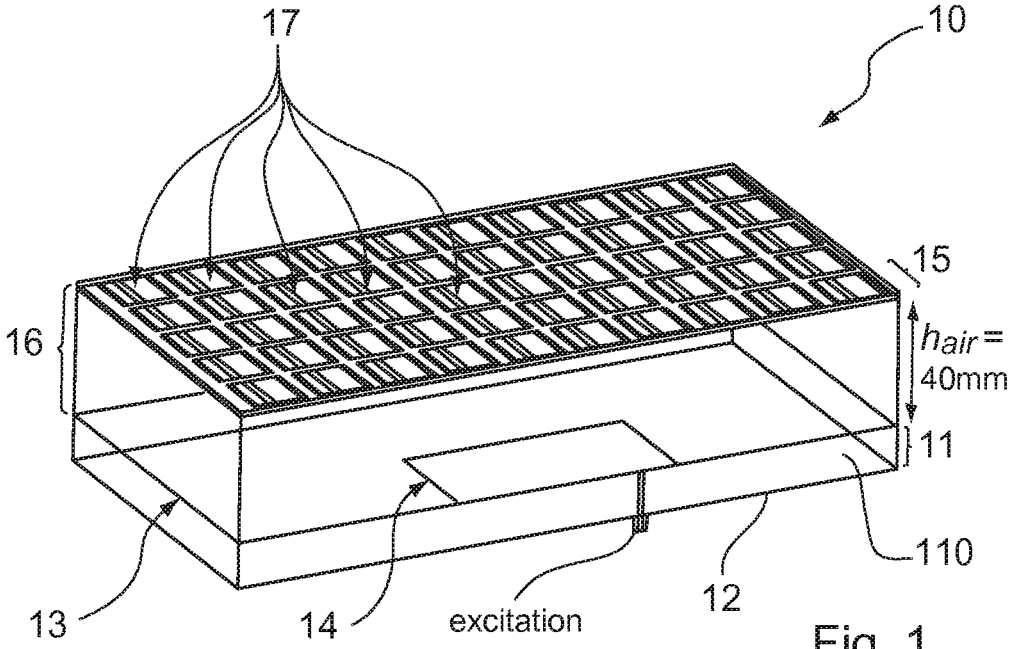
Figure 2:
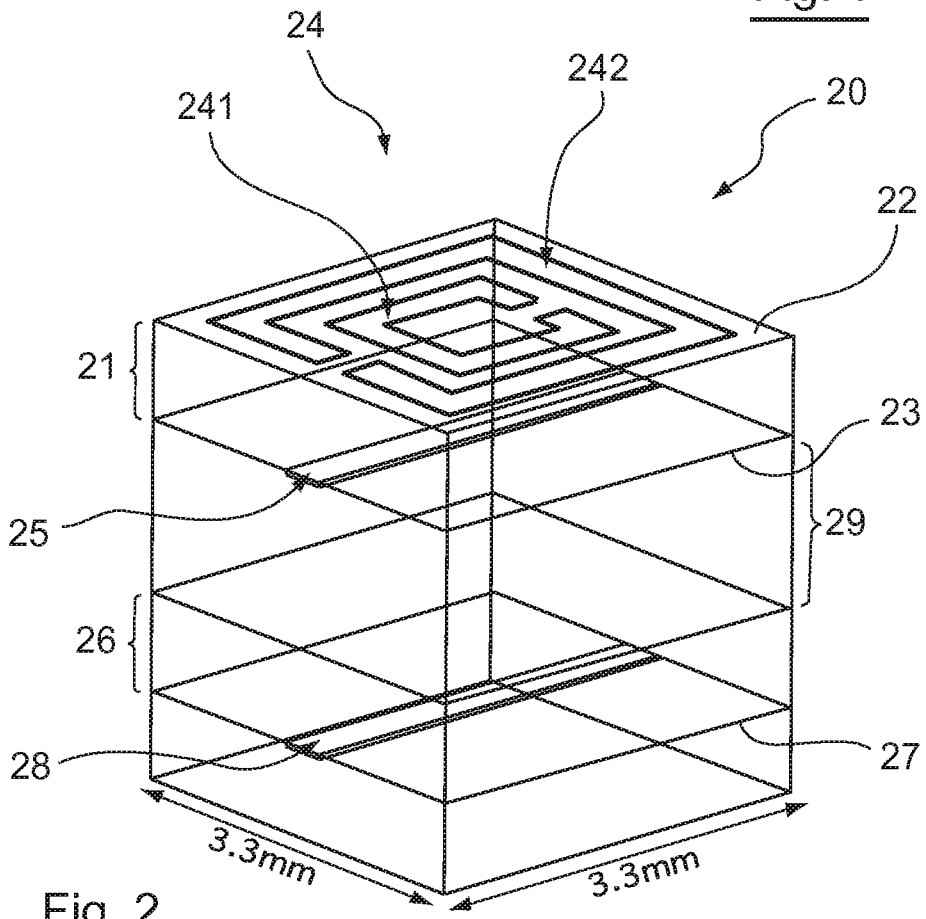
Figure 3:
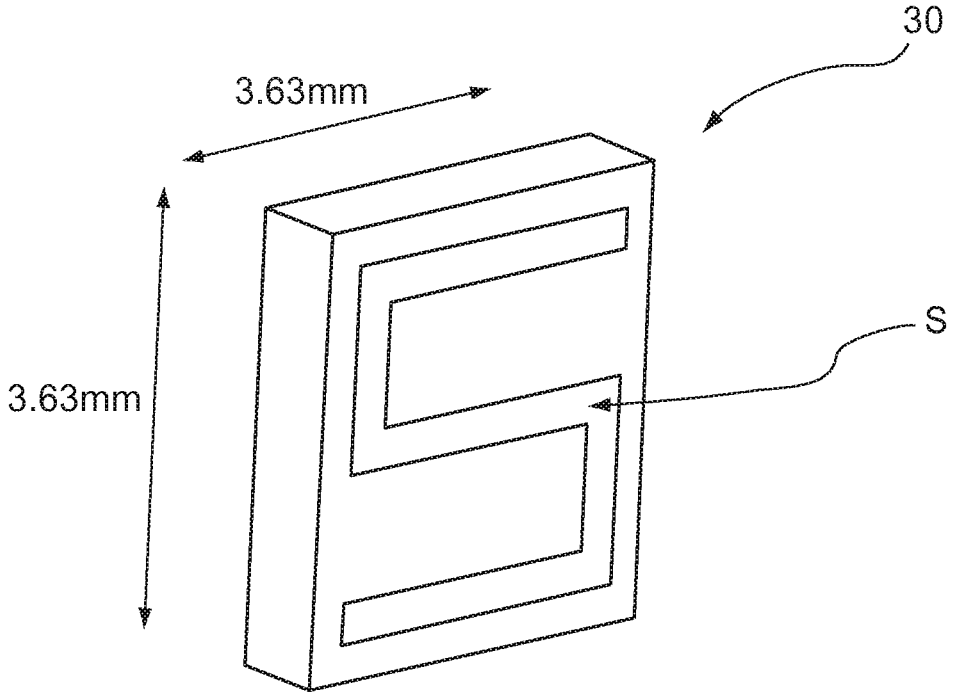

A 3D electromagnetic simulation was done. The HFSS software (registered trademark) was used to simulate performance in terms of reflection coefficient (denoted as S11) and gain of the antenna 401 (without radome) of FIG. 3 in linear polarization (FIGS. 7*a* and 7*b*) and in circular polarization (FIGS. 8*a* and 8*b*).

FIG. 7*a* presents the curve 71 of the reflection coefficient of the antenna of FIG. 5 in linear polarization for the frequency band from 800 MHz to 1 GHz.

FIG. 7*b* presents the gain curve 72 of the antenna of FIG. 5 in linear polarization for the frequency band ranging from 800 MHz to 1 GHz.

As can be seen, the antenna 401 of FIG. 5 in linear polarization has a resonance frequency of about 883 MHz and a maximum gain of about 10 dBi.

FIG. 8*a* presents a curve 81 of the reflection coefficient of the antenna of FIG. 5 in circular polarization for the frequency band ranging from 800 MHz to 1 GHz.

FIG. 8*b* presents the gain curve 82 of the antenna 401 of FIG. 5 in circular polarization for the frequency band ranging from 800 MHz to 1 GHz.

As can be seen, the antenna of FIG. 5 in circular polarization has a resonance frequency of about 881 MHz and a maximum gain of about 9.5 dBi.

Referring again to FIG. 4, the radome 43 has a metamaterial structure according to the invention. This metamaterial structure has a plurality of elementary blocks according to the invention.

Figure 6:
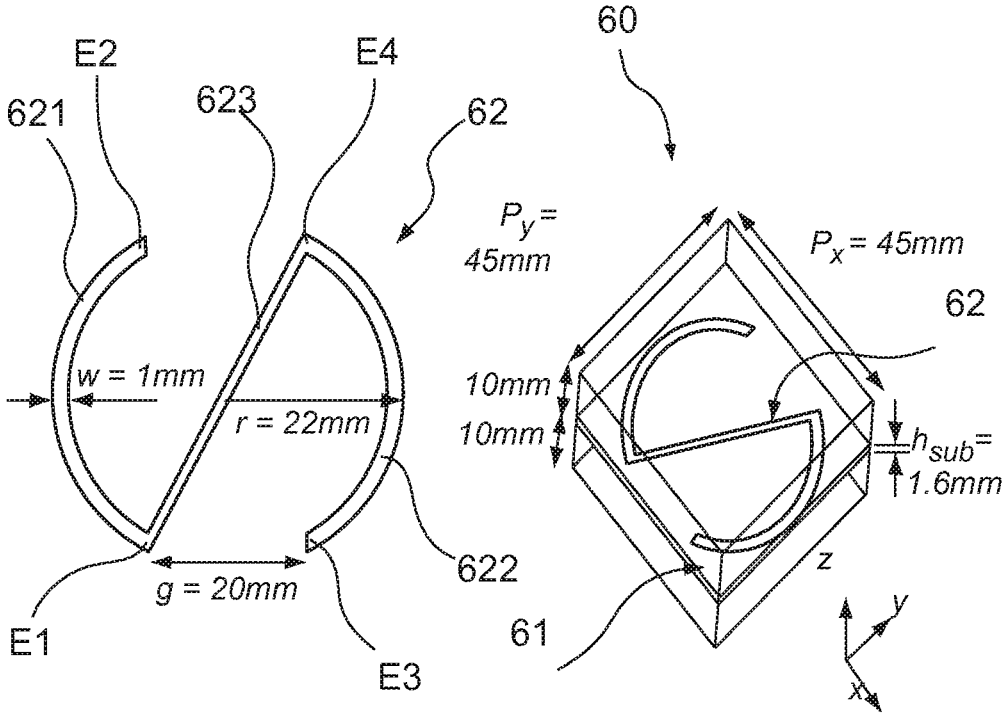

Referring now to FIG. 6, an elementary block of metamaterial according to a first embodiment of the invention described.

In this first embodiment of the invention, the elementary block of metamaterial comprises a square-shaped support 61 of dielectric material with a side of about 45 mm. Thus, and as illustrated in the example of FIG. 4, the radome 43 takes the form of a 5×5 matrix, each cell of which comprises the elementary block of metamaterial 60. Naturally, this example is not exhaustive. For example, the radome 43 can take the form of a cap of a sphere, cone or cylinder.

In one alternative embodiment, the elementary blocks of metamaterial according to the invention can be inserted into or can constitute the substrate of the radiating element.

As illustrated in FIG. 6, the support 61 has a height ($h_{sub}$) of about 1.6 mm.

The elementary block of metamaterial 60 has an electrically conductive unit 62 printed on the upper face of the support 61. For example, the printing of the conductive unit 62 on the support 61 is easily obtained by applying techniques of photolithography. The manufacturing costs are thus reduced. Naturally, other techniques for printing printed circuits can be used.

The conductive unit 62 comprises:

- a first C-shaped conductive element 621 comprising first and second ends E1 and E2;
- a second C-shaped conductive element 622 comprising third and fourth ends E3 and E4; and
- a connector 623 positioned on the upper face of the support 61.

The first and second conductive element 621 and 622 are laid out relative to one another in such a way that the first and third ends E1 and E3 face each other and are separated by a space (g) and the second and fourth ends E2 and E4 face each other and are separated by a space (g).

The connector 623 is configured to connect the first end E1 to the fourth end E4. In this first particular embodiment, the connector 623 is a rectilinear metal strip. In one alternative embodiment, the connector 623 can take a curved shape or a winding shape. In one alternative embodiment, the connector 623 can be configured to connect the second end E2 to the third end E3.

In this first particular embodiment, the width of each of the first and second conductive elements 621 and 622 and of the connector 623 is about 1 mm.

In the example of FIG. 6, the first and second conductive elements 621 and 622 are identical. Each conductive element 621 and 622 is an arc of a circle, the centre of which corresponds to the mid-point of the connector 623. Naturally, in another embodiment, the first and second conductive elements 621 and 622 can be different, i.e. they can have dimensions and C-shaped curves that are different. For example, they can be derived from two circles with different centers. In this case, the frequency of operation could vary, and this constitutes a means of adjustment depending on the desired working frequency.

In the example of FIG. 6, the ends of the first and second conductive elements 621 and 622 are spaced out by about 20 mm. Naturally, in another embodiment, the spaces or gaps between the first and third ends E1 and E3 and the second and fourth ends E2 and E4 can be different. For example, the first and third ends E1 and E3 can be spaced out by about 40 mm and the second and fourth ends E2 and E4 by about 10 mm. In this case, the working frequency can vary, thus constituting a means of adjustment according to the desired working frequency. In these spaces (or gaps), it is possible to envisage placing varicap diodes that connect the end E2 to the end E4 and/or the end E1 to the end E3, and/or placing varicap diodes on the connector strip 623. This makes the antenna system frequency agile.

The HFSS (registered trademark) software was used to simulate the performance in terms of permittivity (∈) and permeability (μ) of an array constituted by elementary blocks of metamaterial 60 according to the first embodiment of the invention (described with reference to FIG. 6).

FIG. 9 presents the curves of real parts of permittivity 91 and permeability 92 of an array constituted by elementary blocks of metamaterial of FIG. 6 for the frequency band ranging from 500 MHz to 1 GHz.

As can be seen, the array constituted by elementary blocks of metamaterial of FIG. 6 has positive permeability in the 500 MHz to 1 GHz band and negative permittivity for frequencies in the 690 MHz to 1 GHz band. Thus, it has been observed that, contrary to the metamaterials based on split-ring resonators and conductive strips of the prior art (described here above), the permittivity of the metamaterial according to the first embodiment of the invention is negative in a frequency band of about 0.5 GHz instead of 0.1 GHz. The use of the metamaterial according to the first embodiment of the invention therefore implies greater stability of the system and therefore flexibility in manufacturing precision.

Referring now to FIGS. 10*a*, 10*b*, 11*a* and 11*b*, we present the results of electromagnetic simulation of the antenna system 40 (antenna with radome) of FIG. 4.

Figure 10A:
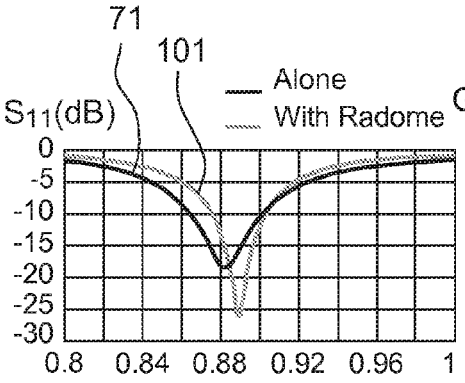
Figure 10B:
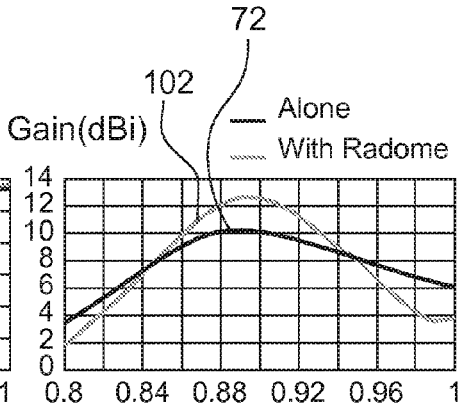

The HFSS software (registered trademark) has been used to simulate the performance in terms of reflection coefficient (denoted as S11) and the gain of the antenna system 40 of FIG. 4 in linear polarization (FIGS. 10*a* and 10*b*) and in circular polarization (FIGS. 11*a* and 11*b*).

In the exemplary embodiment presented, the radome 43 is placed at a distance of about 120 mm (i.e. about $\lambda_0/3$) from the radiating element 42.

FIG. 10*a* presents the curve 101 of the reflection coefficient of the antenna system 40 of FIG. 4 in linear polarization for the frequency band ranging from 800 MHz to 1 GHz. To facilitate the comparison, FIG. 10*a* shows the curve 71 of the reflection coefficient of the antenna 401 (without radome) of FIG. 5 in linear polarization. Thus, in the presence of the radome 43, the adaption is improved.

FIG. 10*b* presents the gain curve 102 of the antenna system 40 of FIG. 4 in linear polarization for the frequency band ranging from 800 MHz to 1 GHz. To facilitate the comparison, FIG. 10*b* shows the gain curve 72 of the antenna 401 (without radome) of FIG. 5 in linear polarization.

As can be seen, the antenna system 40 of FIG. 4 in linear polarization has a resonance frequency of about 889 MHz and a maximum gain of about 12.5 dBi. The radome 43 can therefore increase the overall gain of the antenna in linear polarization by about 2 dBi.

FIG. 11*a* shows the curve 111 of the reflection coefficient of the antenna system 40 of FIG. 4 in circular polarization for the frequency band ranging from 800 MHz to 1 GHz. To facilitate the comparison, FIG. 11*a* shows the curve 81 of the coefficients of reflection of the antenna 401 (without radome) of FIG. 5 in circular polarization. Thus, in the presence of the radome 43, the adaptation is improved.

FIG. 11*b* presents the gain curve 112 of the antenna system 40 of FIG. 4 in circular polarization for the frequency band ranging from 800 MHz to 1 GHz. To facilitate the comparison, FIG. 11*b* shows the gain curve 82 of the antenna 401 (without radome) of FIG. 5 in circular polarization.

As can be seen, the antenna system 40 of FIG. 4 in circular polarization shows a resonance frequency of about 889 MHz and a maximum gain of about 10.3 dBi. The radome 43 therefore increases the overall gain of the antenna in circular polarization by about 1 dBi.

According to one advantageous embodiment of the invention, and as illustrated in FIG. 11*c*, the radome 43 can be oriented relative to the antenna 401 at an angle of orientation determined as a function of the increase in gain desired in the plane Φ and/or θ. In the example of FIG. 11*c*, the radome 43 is oriented at an angle of orientation of +45° relative to the antenna 401. For the example of FIG. 11*c*, it has been noted that the increase in gain is about 2 dBi along θ. In another example (not shown) the radome 43 is oriented at an angle of orientation of −45° relative to the antenna 401. For this example, it has been noted that the increase in gain is about 2 dBi along Φ. In one alternative embodiment, it is possible to envisage implementing a system to make the radiating element or the radome pivot between −45° and +45° in order to encourage radiation in the direction envisaged. In one alternative embodiment, the conductive unit 62 can include one or more active components (semiconductor components) such as for example varicap diodes. The antenna system 40 could for example include a dynamic control device for controlling such active components. For example, it is possible to envisage a control device for controlling the varicap diodes in voltage.

Figure 12:
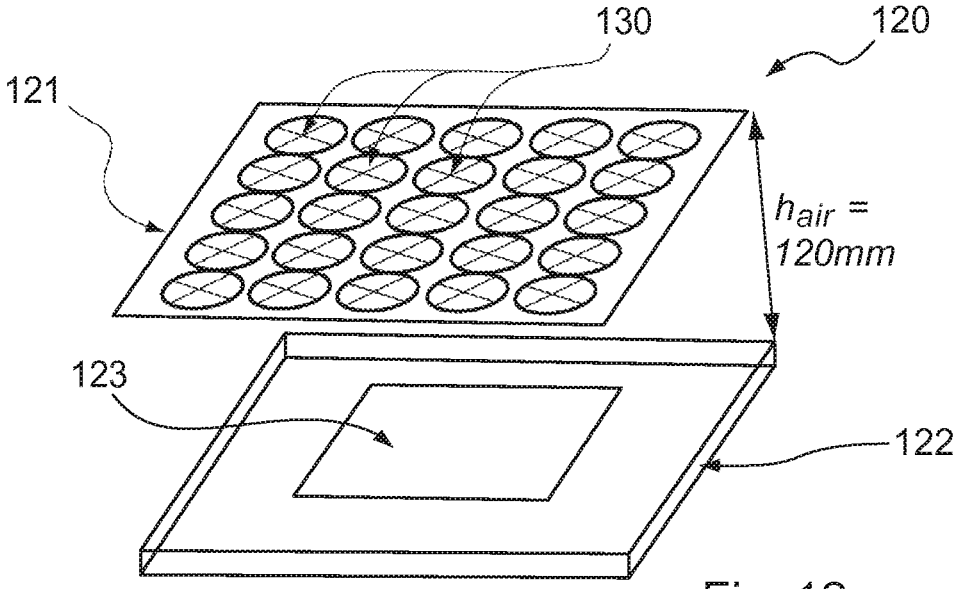
FIG. 12 illustrates an example of an antenna system comprising a radome made of metamaterial according to a second embodiment of the invention.

6.2 A Radome Made of Metamaterials According to a Second Embodiment of the Invention FIG. 12 illustrates an example of an antenna system comprising a radome made of metamaterials according to a second embodiment of the invention.

The antenna system 120 comprises:

a patch antenna 125 comprising:

a carrier structure 122;

a square-shaped radiating element 123; and a radome 121.

The carrier structure 122 and the radiating element 123 are respectively identical to the carrier structure 41 and the radiating element 42 described here above with reference to FIGS. 4 and 5. These elements are therefore not described again here below.

The radome 121 comprises a metamaterial structure. This metamaterial structure comprises a plurality of elementary blocks according to the invention.

Figure 13:
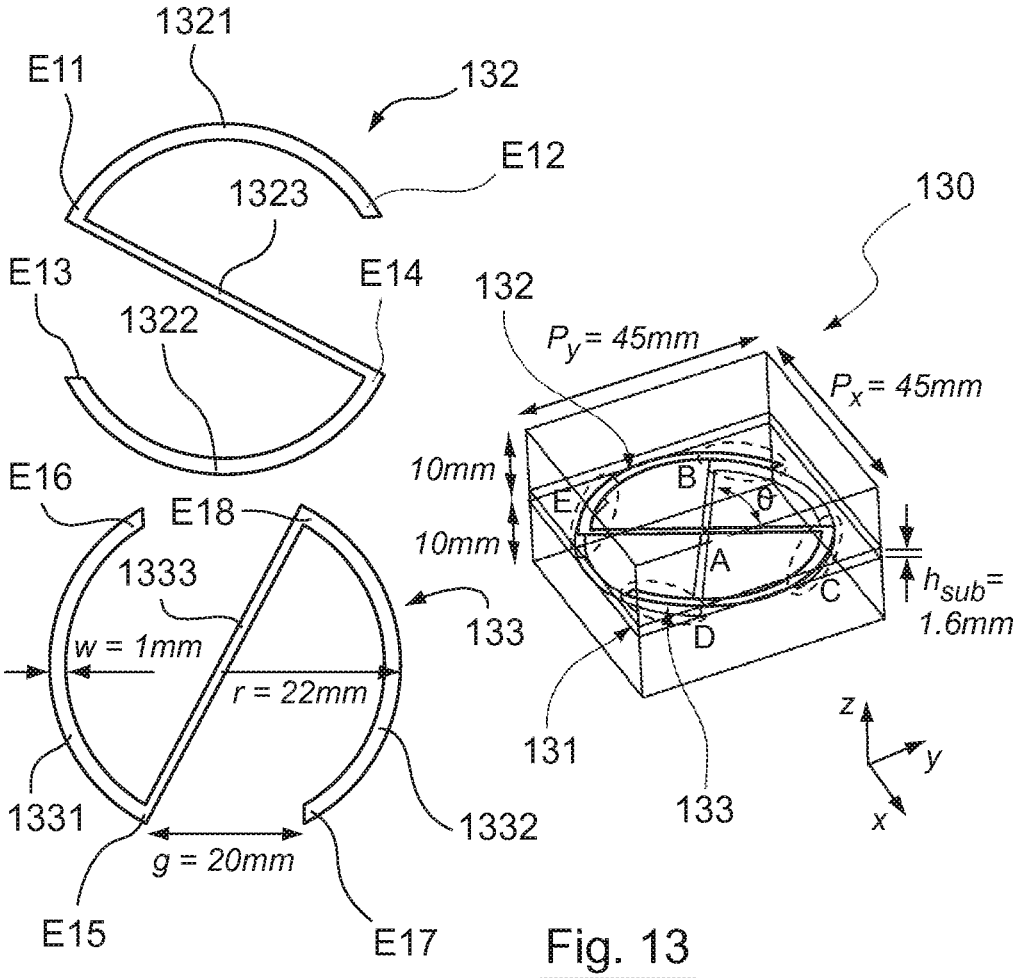
FIG. 13 illustrates an elementary block of metamaterial according to the second embodiment of FIG. 12.

Referring now to FIG. 13, we describe an elementary block of metamaterial according to a second embodiment of the invention.

In this second embodiment of the invention, the elementary block of metamaterial 130 comprises a support 130 made of square-shaped dielectric material and having a side of about 45 mm. Thus, and as illustrated in the example of FIG. 12, the radome 121 has the shape of a 5×5 matrix, each cell of which comprises the elementary block of metamaterial 130. Naturally, this example is not exhaustive. For example, the radome 121 can take the shape of a spherical cap, a cone or a cylinder.

As illustrated in FIG. 13, the support 131 has a height ($h_{sub}$) of about 1.6 mm. It can be noted that this height is one of the parameters which can be acted upon to change the frequency of operation of the system if necessary.

The elementary block of metamaterial 130 comprises a first electrically conductive unit 132 printed on the upper face of the support 131 and a second electrically conductive unit 133 printed on the lower surface of the support 131.

For example, the printing of the conductive units 132 and 133 and the support 131 is obtained by implementing photolithography techniques. In this way, the costs of manufacture are reduced. Naturally, other techniques for printing printed circuits can be implemented.

The first conductive unit 132 comprises:

a first C-shaped conductive element 1321 comprising first and second ends E11 and E12;

a second C-shaped conductive element 1322 comprising third and fourth ends E13 and E14; and a connector 1323 arranged on the upper face of the support 131.

The first and second conductive elements 1321 and 1322 are laid out relative to each other in such a way that the first and third ends E11 and E13 face each other and are separated by a space, and the second and fourth ends E12 and E14 face each other and are separated by a space (g).

The connector 1323 is configured to connect the first end E11 to the fourth end E14. In this example of an embodiment, the connector 1323 has a rectilinear shape. In one alternative embodiment, the connector can take a curved or winding shape. In one alternative embodiment, the connector 1323 can be configured to connect the second end E12 to the third end E13.

The second conductive unit 133 comprises:

a third C-shaped conductive element 1331 comprising fifth and sixth ends E15 and E16;

a fourth C-shaped conductive element 1332 comprising seventh and eighth ends E17 and E18; and a connector 1333 positioned on the lower face of the support 131.

The third and fourth conductive elements 1331 and 1332 are laid out relative to each other in such a way that the fifth and seventh ends E15 and E17 face each other and are separated by a space (g) and the sixth and eighth ends E16 and E18 face each other and are separated by a space (g).

The connector 1333 is configured to connect the fifth end E15 to the eighth end E18. In this example of an embodiment, the connector 1333 has a rectilinear shape.

As illustrated, the connectors 1323 and 1333 are laid out relative to each other in such a way that they are superimposed at their mid-point A. In other words, the mid-points of the connectors 1323 and 1333 are superimposed.

The connector 1323 forms an angle θ with the connector 1333. In this second particular example of an embodiment, the connector 1323 extends perpendicularly to the connector 1333 (in other words θ=90°). In other words, the first and second conductive units 132 and 133 are superimposed with a 90° rotation of the first connector relative to the second connector. Naturally, this example is not exhaustive. For example, the angle θ can take a value of 10° to 170°.

In this second example of a particular embodiment, the width of each of the conductive elements and the connectors is about 1 mm. It can be noted that this width constitutes one of the parameters that can be modified to change the frequency of operation of the system if necessary.

In the example of FIG. 13, the first and second conductive units 132 and 133 are identical. As can be seen, the conductive elements 1321 and 1322 of the first conductive unit 132 and the conductive elements 1331 and 1332 of the second conductive unit 133 overlap at certain places B, C, D and E. These overlaps have the effect of diminishing the frequency of operation of the system. Naturally, in another embodiment, the first and second conductive units 132 and 133 can have different dimensions in such a way that, for example, the second conductive unit 133 extends inside the first conductive unit 132.

Another alternative embodiment may consist in placing or printing the two conductive units, which are concentric or have different dimensions, on the same face of the dielectric or magnetic support (substrate). To prevent electric contact between the two metal strips 1323 and 1333, it is proposed to make two via holes on either side of one of the connectors, enabling the two arms of the other connector to be linked through the opposite face of the support, since it is possible to totally print one of the two connectors 1323 or 1333 to the opposite support face and link its ends to the opposite ends of the two inner C-shaped elements.

In the example of FIG. 13, the ends of the first and second conductive elements 1321 and 1322 are spaced out by a distance (g) of about 20 mm and the ends of the third and fourth conductive elements 1331 and 1332 are spaced out by a distance (g) of about 20 mm. Naturally, other spacing values (g) can be envisaged. In this case, the frequency of operation could vary, this variation constituting a means of adjusting to the desired working frequency.

Besides, in one alternative embodiment, it is proposed to replace these spacings (g) by varicap diodes.

Referring now to FIGS. 14*a* and 14*b*, we present the results of electromagnetic simulation of the antenna system 120 (antenna with radome) when the radome 121 is oriented along an angle of orientation of +45° relative to the radiating element 123. This electromagnetic simulation has been done by means of the HFSS (registered trademark) software.

In the example of an embodiment presented, the radome 121 is placed at a distance of about 80 mm (i.e. about $\lambda_0/4$) from the radiating element 123.

FIG. 14*a* presents the curve 141 of the reflection coefficient of the antenna system 120 of FIG. 12 in circular polarization for the frequency band ranging from 840 MHz to 1 GHz. To facilitate the comparison, FIG. 14*a* shows the curve 81 of the reflection coefficient of the antenna 401 (without radome) of FIG. 5 in circular polarization. Thus, in the presence of the radome 121, the adaptation is improved.

FIG. 14*b* presents the gain curve 142 of the antenna system 120 of FIG. 12 in circular polarization for the frequency band ranging from 840 MHz to 1 GHz. To facilitate the comparison, FIG. 14*b* shows the gain curve 82 of the antenna 401 (without radome) of FIG. 5 in circular polarization.

As can be seen, the antenna system 120 of FIG. 12 in circular polarization has a resonance frequency of about 07 MHz and a maximum gain of about 10.7 dBi. The radome 121 therefore increases the overall gain of the antenna in circular polarization by about 1 dBi. Furthermore, relative to the radome 43 of FIG. 4 (comprising only one conductive unit on the upper face of the support), the radome 121 (comprising a conductive unit on the upper face of the support and a conductive unit on the lower face of the support) makes the circular polarization of the antenna perfect.

6.3 Radome Made of Left-Handed Material Optimized for the UHF-RFID Band

Radomes made of left-handed material, capable of working in the X band or the high UHF band (i.e. for frequencies above 2 GHz) are already known. However, to date, there are no solutions for the low UHF band (i.e. for frequencies below 2 GHz).

A novel radome is proposed herein, made of left-handed material capable of working in the low UHF band and especially in the UHF-RFID band (860 MHz to 960 MHz). As shall be seen here below, this novel radome made of a left-handed material significantly increases the gain of a UHF-RFID antenna with rectilinear polarization.

FIG. 15 illustrates an example of an antenna system comprising a radome made of left-handed material optimized for the UHF-RFID band. For reasons of clarity, only half of the antenna system is shown in FIG. 15.

The antenna system 160 comprises:

a patch antenna 165 comprising:

a carrier structure 162;

a square-shaped radiating element 163; and a radome 161.

In this example, the carrier structure 162 and the radiating element 163 are respectively identical to the carrier structure 41 and the radiating element 42 described here above with reference to the examples of FIGS. 4 and 5. These elements are therefore not described again here below.

The radome 161 comprises a structure made of left-handed material optimized for the UHF-RFID band. This structure made of left-handed material comprises a plurality of elementary blocks 170 arranged in rows and columns in a matrix.

FIG. 16 illustrates an elementary block of left-handed material optimized for the UHF-RFID band.

The elementary block of left-handed material 170 comprises a support 171 made of dielectric material comprising an upper face 172 on which there is placed a split-ring resonator 174 and a lower face 173 on which there is placed a linear metal strip 175.

The support 171 is square-shaped. Naturally, it can have another shape (rectangular, circular, etc depending on the shape of the split-ring resonator). Each side of the square is about 22 mm. The support 171 has a height ($h_{sub}$) of about 1.6 mm but can have a different size.

The split-ring resonator 174 comprises an inner slotted square 1741 and an outer slotted square 1742.

The inner slotted square 1741 is formed by a metal track with a width of about 1 mm. Each side of the inner slotted square 1741 has a length of about 17 mm. The inner slotted square 1741 has a slot with a width of about 2 mm.

The spacing between the inner slotted square 1741 and outer slotted square 1742 is about 0.5 mm.

The outer slotted square 1742 is formed by a metal track with a width of about 1 mm. Each side of the outer slotted square 1742 is about 20 mm. The outer slotted square 1742 has a slot whose width is appreciably equal to that of the slot of the inner slotted square 1741, i.e. about 2 mm. The slots of the inner slotted square 1741 and outer slotted square 1742 are aligned with each other.

The rectilinear metal strip 175 has a length substantially equal to that of the support 171, i.e. about 22 mm, and a width substantially equal to that of the slots, i.e. about 2 mm.

The HFSS (registered trademark) software was used to extract the parameters of permittivity ($\in$) and permeability ($\mu$) of an array constituted by elementary blocks of left-handed material 170.

FIG. 17 presents the curves of the real parts of permittivity 181, permeability 182 and refraction index of an array constituted by elementary blocks 170 of FIG. 16 for the frequency band ranging from 500 MHz to 1 GHz.

As can be seen, the array constituted by elementary blocks of left-handed material of FIG. 16 simultaneously has permeability and permittivity that are negative for frequencies within the 790 MHz to 920 MHz band.

Referring now to FIGS. 18*a* and 18*b*, the results of electromagnetic simulation of the antenna system 160 (antenna with radome) of FIG. 15 are presented. This electromagnetic simulation was done by means of the HFSS (registered trademark) software.

In the example of an embodiment presented, the radome 161 is placed at a distance of about 80 mm (i.e. about $\lambda_0/4$) from the radiating element 163.

FIG. 18*a* presents the curve 191 of the reflection coefficient of the antenna system 160 of FIG. 15 in linear polarization for the frequency band ranging from 840 MHz to 1 GHz. To facilitate the comparison, FIG. 18*a* shows the curve 81 of the reflection coefficient of the antenna 401 (without radome) of FIG. 5 in linear polarization.

FIG. 18*b* presents the gain curve 192 of the antenna system 160 of FIG. 15 in linear polarization for the frequency band ranging from 840 MHz to 1 GHz. To facilitate the comparison, FIG. 18*b* shows the gain curve 82 of the antenna 401 (without radome) of FIG. 5 in linear polarization.

As can be seen, the antenna system 160 of FIG. 15 in linear polarization has a resonance frequency at about 918 MHz and a maximum gain of about 13.2 dBi. The radome 161 therefore increases the overall gain of the antenna in linear polarization by about 3 dBi.

6.4 Radome Made of Metamaterial, Based on a Split Resonator Optimized for the UHF-RFID Band Radomes made of left-handed material based on split-ring resonators, capable of working in the X band or at frequencies above 2 GHz are already known. However, to date, there are no solutions for the low UHF band (i.e. for frequencies below 2 GHz).

A novel radome is proposed herein, made of left-handed material based on split-ring resonators, capable of working in the low UHF band and especially in the UHF-RFID band (860 MHz to 960 MHz). As shall be seen here below, this novel radome made of left-handed material significantly increases the gain of a UHF-RFID antenna with rectilinear polarization.

FIG. 19 illustrates an example of an antenna system comprising a radome made of left-handed material optimized for the UHF-RFID band. For reasons of clarity, only half of the antenna system is shown in FIG. 19.

The antenna system 2000 comprises:

- a patch antenna 2005 comprising:
  - a carrier structure 2002 constituted by FR4 with a thickness of about 14.4 mm;
  - a ground plane 2004;
  - a square-shaped radiating element 2003; and
- a radome 2001.

In this example, the radiating element 2003 and the ground plane 2004 are sized to work in the UHF-RFID band. In one particular embodiment, the length of the radiating element 2003 is about 75 mm and the length of the ground plane 2004 is about 225 mm. FIG. 20 presents the gain curve 2100 of the antenna of FIG. 19 when there is no radome, in linear polarization for the frequency band ranging from 800 MHz to 1 GHz.

The radome 2001 comprises an array of split resonators optimized for the UHF-RFID band.

FIG. 21 illustrates an elementary block comprising a split resonator optimized for the UHF-RFID band.

The elementary block 2200 has a support 2201 made of dielectric material comprising an upper face 2202 on which a split-ring resonator 2204 is placed.

The support 2201 is square-shaped. Naturally, it can have any other shape (rectangular, circular, etc.) depending on the shape of the split-ring resonator. Each side of the square measures about 22 mm. The support 2201 has a height ($h_{sub}$) of about 1.6 mm.

The split-ring resonator 2204 comprises an inner slotted square 22041 and an outer slotted square 22042.

The inner slotted square 22041 is formed by a metal track with a width of about 1 mm. Each side of the inner slotted square 22041 has a length of about 17 mm. The inner slotted square 22041 has a slot with a width of about 2 mm.

The spacing between the inner slotted square 22041 and outer slotted square 22042 is about 0.5 mm.

The outer slotted square 22042 is formed by a metal track with a width of about 1 mm. Each side of the outer slotted square 22042 is about 20 mm. The outer slotted square 22042 has a slot whose width is appreciably equal to that of the slot of the inner slotted square 22041, i.e. about 2 mm. The slots of the inner slotted square 22041 and outer slotted square 22042 are aligned with each other.

The HFSS (registered trademark) software was used to extract parameters of permittivity (∈) and permeability (μ) of an array constituted by elementary blocks of left-handed material 170.

FIG. 22 presents the curves of the real parts of permittivity 181 and permeability 182 of an array constituted by elementary blocks 2200 of FIG. 21 for the frequency band ranging from 500 MHz to 1 GHz.

As can be seen, the array constituted by elementary blocks of FIG. 21 has permeability negative for frequencies within the 820 MHz to 900 MHz band.

Referring now to FIG. 23, the results of electromagnetic simulation of the antenna system 2000 (antenna with radome) of FIG. 19 are presented. This electromagnetic simulation was done by means of the HFSS (registered trademark) software.

In the example of an embodiment presented, the radome 2001 is placed at a distance of about 40 mm (i.e. about $\lambda_0/4$) from the radiating element 2003.

FIG. 23 presents the gain curve 2402 of the antenna system 2000 of FIG. 19 in linear polarization for the frequency band ranging from 840 MHz to 1 GHz. To facilitate the comparison, FIG. 23 shows the gain curve 2100 of the antenna 2005 (without radome) in linear polarization.

As can be seen, the antenna system 2000 of FIG. 19 in linear polarization has a resonance frequency of about 940 MHz and a maximum gain of about 8.2 dBi. The radome 2001 therefore increases the overall gain of the antenna in linear polarization by about 2.4 dBi.

Although the invention has been described here above with reference to a limited number of embodiments, those skilled in the art, in reading the present description, will understand that other embodiments can be imagined without departing from the framework of the present invention.

For example, the antenna structure (here above also called an antenna system) can be constituted by a radiating element, a ground plane and a radome made metamaterial that is parallelepiped-shaped or in the shape of a solid or hollow spherical cap. Such a radome is transparent to electromagnetic waves. The radiating element can be a planar, wire or volume structure and have any unspecified geometrical shape. The radiating element can be separated from the ground plane by a volume which can be constituted by air, dielectric material and/or magnetic material.

In one alternative embodiment, it can be that the antenna structure does not have a ground plane. In this case, it is proposed to implement a second radome made of metamaterial according to the invention. This second radome extends beneath the radiating element and is placed at the same distance from the radiating element as the first radome (extending above the radiating element). For example, the metamaterial radome can take the form of a cylinder (the radiating element extending within the cylinder). This radome is therefore well-suited to the case of a half-wave wire antenna or a helical antenna.

According to one advantageous embodiment of the invention, and as illustrated in FIGS. 24, 25 and 26, the radome made of metamaterial according to the invention can be positioned vertically or perpendicularly to the plane of the radiating element. It has been observed that if the radome made of metamaterial according to the invention is positioned vertically to the plane of the radiating element (FIG. 24), there is an increase in gain of about 3 dBi and the resonance frequency (or working frequency) does not change in the presence of the radome. The circular polarization is perfect.

More specifically, at least one embodiment of the invention provides a metamaterial structure that is simple to manufacture industrially and is at the same time being compatible with numerous applications.

At least one particular embodiment of the invention is aimed at providing a metamaterial structure of this kind that makes it possible to obtain an antenna radome.

At least one embodiment of the invention provides an antenna radome of this kind that improves the characteristics of radiation of an antenna, while at the same time reducing (or at the very least not increasing) its dimensions.

At least one embodiment of the invention provides an antenna radome of this kind that is compatible with operation in linear and/or circular polarization.

At least one embodiment of the invention provides an antenna radome of this kind that is adapted to antennas of RFID base stations in the UHF band.

The invention claimed is:

1. A metamaterial structure comprising:

at least one elementary block comprising:

a support made of dielectric material, said support comprising an upper face and a lower face; and a first electrically conductive unit placed on the upper face of the support and comprising:

a first C-shaped conductive element in the shape of an arc of a circle and comprising first and second ends;

a second C-shaped conductive element in the shape of an arc of a circle and comprising third and fourth ends, said first and second conductive elements being laid out relative to each other in such a way that the first and third ends face each other and are separated by a first space, and the second and fourth ends face each other and are separated by a second space; and a first connector configured to connect the first end to the fourth end.

2. The metamaterial structure according to claim 1, wherein that said first and second C-shaped conductive elements are identical.

3. The metamaterial structure according to claim 1, wherein the first connector has a rectilinear shape.

4. The metamaterial structure according to claim 1, wherein said at least one elementary block comprises a second electrically conductive unit placed on the lower face of the support and comprising:

a third C-shaped conductive element comprising fifth and sixth ends;

a fourth C-shaped conductive element) comprising seventh and eighth ends, said third and fourth conductive elements being laid out relative to each other in such a way that the fifth and seventh ends face each other and are separated by a third space, and the sixth and eighth ends face each other and are separated by a fourth space; and a second connector configured to connect the fifth end to the eighth end, and wherein the mid-points of the first and second connectors are superimposed.

5. The metamaterial structure according to claim 4, wherein said first and second conductive units are superimposed with a 90° rotation of the first connector relative to the second connector.

6. The metamaterial structure according to claim 4, wherein said first and second conductive units are identical.

7. The metamaterial structure according to claim 4, wherein said second conductive unit comprises at least one active component.

8. The metamaterial structure according to claim 4, wherein said first conductive unit comprises at least one active component and said second conductive unit comprises at least one active component.

9. The metamaterial structure according to claim 1, wherein said first conductive unit comprises at least one active component.

* * * * *